US010914264B2

(12) United States Patent
Idogawa

(10) Patent No.: US 10,914,264 B2
(45) Date of Patent: Feb. 9, 2021

(54) AIR-FUEL RATIO CONTROL APPARATUS AND METHOD FOR INTERNAL COMBUSTION ENGINE

(71) Applicant: TOYOTA JIDOSHA KABUSHIKI KAISHA, Toyota (JP)

(72) Inventor: Masanao Idogawa, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 881 days.

(21) Appl. No.: 15/608,367

(22) Filed: May 30, 2017

(65) Prior Publication Data

US 2017/0370320 A1 Dec. 28, 2017

(30) Foreign Application Priority Data

Jun. 23, 2016 (JP) ..... 2016-124866

(51) Int. Cl.
*F02D 41/30* (2006.01)
*F02D 41/26* (2006.01)
(Continued)

(52) U.S. Cl.
CPC ..... *F02D 41/3094* (2013.01); *F02D 41/1454* (2013.01); *F02D 41/2445* (2013.01);
(Continued)

(58) Field of Classification Search
CPC .... F02D 41/182; F02D 41/248; F02D 41/263; F02D 41/1454; F02D 41/2445;
(Continued)

(56) References Cited

U.S. PATENT DOCUMENTS 5,495,835 A * 3/1996 Ueda ..... F02D 37/02 123/339.11
5,531,208 A * 7/1996 Hasegawa ..... F02D 41/008 123/673
(Continued)

FOREIGN PATENT DOCUMENTS

JP 2005-048730 A 2/2005
JP 2005-307756 A 11/2005
(Continued)

*Primary Examiner* — Phutthiwat Wongwian
*Assistant Examiner* — Arnold Castro
(74) *Attorney, Agent, or Firm* — Oliff PLC

(57) ABSTRACT

An engine includes a first injection valve, which is one of port and direct injection valves, and a second injection valve, which is the other. When operating only the first injection valve based on a base injection amount, which has been corrected using a feedback operation amount and a first learning value, an air-fuel ratio control apparatus updates the first learning value and determines that the first learning value has converged on condition that a correction ratio of the base injection amount is not more than a predetermined ratio. When the first and second injection valves are being operated, the apparatus updates a second learning value for the second injection valve on condition that the first learning value has converged and the ratio of the injection amount of the second injection valve is not less than a specified value.

6 Claims, 9 Drawing Sheets

(51) Int. Cl.
*F02D 41/24* (2006.01)
*F02D 41/14* (2006.01)
*F02D 41/18* (2006.01)

(52) U.S. Cl.
CPC ..... *F02D 41/2467* (2013.01); *F02D 41/263* (2013.01); *F02D 41/182* (2013.01); *F02D 41/248* (2013.01); *F02D 2200/0614* (2013.01)

(58) Field of Classification Search
CPC ..... F02D 41/2467; F02D 41/3094; F02D 41/2441; F02D 41/2451; F02D 41/2454
USPC ..... 123/431, 575, 576, 674
See application file for complete search history.

(56) References Cited

U.S. PATENT DOCUMENTS 5,832,901 A * 11/1998 Yoshida ..... F02D 41/3029 123/478
6,917,874 B2 * 7/2005 Uchida ..... F02D 13/0219 123/568.11
6,932,053 B2 * 8/2005 Ichihara ..... F02D 37/02 123/344
7,200,449 B2 * 4/2007 Yasui ..... F02D 41/1402 700/28
7,356,985 B2 * 4/2008 Hirata ..... F02D 41/008 123/673
7,610,898 B2 * 11/2009 Hiraku ..... F02D 13/08 123/339.14
7,996,143 B2 * 8/2011 Okazaki ..... F02D 41/0042 123/516
8,918,269 B2 * 12/2014 Irie ..... F02D 41/0062 123/406.44
10,041,433 B2 * 8/2018 Hollar ..... F02D 41/10
10,208,686 B1 * 2/2019 Thomas ..... F02D 41/008
2006/0207557 A1 * 9/2006 Ito ..... F02D 41/068 123/431
2006/0207558 A1 * 9/2006 Tahara ..... F02M 69/046 123/431
2006/0207559 A1 9/2006 Kinose et al.
2009/0138181 A1 * 5/2009 Hokuto ..... F02D 41/1475 701/106
2015/0167580 A1 * 6/2015 Toda ..... F02D 41/38 123/294
2017/0370320 A1 * 12/2017 Idogawa ..... F02D 41/2445
2018/0017007 A1 * 1/2018 Kuroda ..... F02D 41/2467
2018/0023498 A1 * 1/2018 Kuroda ..... F02D 41/3094 701/104

FOREIGN PATENT DOCUMENTS

JP 2006-258037 A 9/2006
JP 2007-032325 A 2/2007

* cited by examiner

AIR-FUEL RATIO CONTROL APPARATUS AND METHOD FOR INTERNAL COMBUSTION ENGINE

BACKGROUND OF THE INVENTION

The present invention relates to an air-fuel ratio control apparatus and method for an internal combustion engine, and more particularly, to an air-fuel ratio control apparatus and method for controlling an internal combustion engine that includes both a port injection valve, which injects fuel into the intake passage, and a direct injection valve, which injects fuel into the combustion chamber.

When operating a fuel injection valve based on a base injection amount, which is the open-loop operation amount for controlling the air-fuel ratio to a target value, the actual air-fuel ratio can deviate from the target value, for example due to a deviation of the injection characteristics of the fuel injection valve from reference characteristics and the difference between the actual in-cylinder intake air amount and the in-cylinder intake air amount that was used in computation of the base injection amount. In contrast, in the case of operating a fuel injection valve through feedback control in addition to the open-loop control using the base injection amount, the difference between the air-fuel ratio and the target value caused by the open-loop control (an error in the air-fuel ratio control based on the base injection amount) is compensated by a feedback operation amount. Further, it is known that, in the air-fuel ratio control, a compensation amount for compensating an error in the air-fuel ratio control caused by the base injection amount is learned as a learning value.

For example, Japanese Laid-Open Patent Publication 2005-48730 discloses an air-fuel ratio control apparatus that learns a learning value. When the learning of a learning value for a port injection valve is completed during the air-fuel ratio feedback control using the port injection valve and a direct injection valve, the correction ratio for the base injection amount, which is obtained using the feedback operation amount, may have a value other than zero. In this case, the apparatus of the publication assumes that the cause is the learning value for the direct injection valve and updates the learning value for the direct injection valve based on the feedback operation amount.

However, even if the learning of a learning value for the port injection valve is completed during the air-fuel ratio feedback control using the port injection valve and the direct injection valve, the use of the learning value for the direct injection valve is not necessarily the only cause of the correction ratio for the base injection amount obtained using the feedback operation amount being a value other than zero. In particular, when the fuel injection ratio of the port injection valve is great, one of the main causes of the correction ratio for the base injection amount obtained using the feedback operation amount being a value other than zero is more likely to be the learning value for the port injection valve. Then, if one of the main causes of the correction ratio for the base injection amount obtained using the feedback operation amount being a value other than zero is the learning value for the port injection valve, the update of the learning value for the direct injection valve would reduce the accuracy of the update.

SUMMARY OF THE INVENTION

An objective of the present invention is to provide an air-fuel ratio control apparatus and method for an internal combustion engine that are capable of highly accurately updating a learning value based on a feedback operation amount when air-fuel ratio feedback control is being performed through operation of a port injection valve and a direct injection valve.

To achieve the foregoing objective, an air-fuel ratio control apparatus for an internal combustion engine is provided. The engine includes a first injection valve, which is one of a port injection valve that injects fuel into an intake passage and a direct injection valve that injects fuel into a combustion chamber, and a second injection valve, which is the other. The air-fuel ratio control apparatus includes an open-loop processing section, a feedback processing section, an operation processing section, a first updating section, a first determining section, and a second updating section. The open-loop processing section is configured to set a base injection amount, which is an open-loop operation amount for controlling an air-fuel ratio to a target value. The feedback processing section is configured to calculate a feedback operation amount for controlling a detection value of the air-fuel ratio to the target value. The operation processing section is configured to perform, to supply fuel to the combustion chamber of the engine, at least one of an operation of the first injection valve based on the base injection amount that has been corrected using the feedback operation amount and a first learning value, and an operation of the second injection valve based on the base injection amount that has been corrected using the feedback operation amount and a second learning value. The first updating section is configured to update the first learning value based on the feedback operation amount when the operation processing section is operating only the first injection valve. The first determining section configured to, when the first updating section is updating the first learning value, determine that the first learning value has converged on condition that a correction ratio of the base injection amount, which is obtained using the feedback operation amount, is less than or equal to a predetermined ratio. The second updating section is configured to update the second learning value based on the feedback operation amount when the operation processing section is operating both the first injection valve and the second injection valve. The second updating section is configured to update the second learning value on condition that the first learning value is determined to have converged and an injection distribution ratio, which is a ratio of an injection amount of the second injection valve to a total injection amount of the first injection valve and the second injection valve, is greater than or equal to a specified value. Also, the second updating section is configured to refrain from updating the second learning value when the injection distribution ratio is less than the specified value.

In the above configuration, the update conditions are used that need to be satisfied when the second updating section updates the second learning value to the feedback operation amount when the first injection valve and the second injection valve are being operated. The update conditions include the condition that the injection distribution ratio is higher than or equal to the specified value in addition to the condition that the first learning value has converged. Thus, when one of the main causes of the correction ratio for the base injection amount obtained using the feedback operation amount being a value other than zero may be the first learning value, the second learning value is restrained from being updated by adjusting the specified value. Therefore, it is possible to highly accurately update the learning value based on the feedback operation amount when the air-fuel ratio feedback control is performed by operating the port injection valve and the direct injection valve.

In the above described air-fuel ratio control apparatus, the first updating section may be configured to update the first learning value for each of a plurality of learning regions, which are divided in accordance with values of an intake air amount of the internal combustion engine. The operation processing section may be configured to, when operating both the first injection valve and the second injection valve, operate the first injection valve based on the first learning value in a learning region including the intake air amount at the time. When the first injection valve and the second injection valve are both being operated, the second updating section may be configured to update the second learning value in a learning region including the intake air amount at the time if conditions are satisfied that include a condition that the first learning value in the learning region has converged.

With the above configuration, when both the first injection valve and the second injection valve are operated, the first injection valve is operated based on the first learning value in the learning region that includes the intake air amount at the time. In that case, the second learning value in the learning region is updated when conditions are satisfied that include a condition that the first learning value in the learning region including the intake air amount has converged. Therefore, on condition that the reliability of the first learning value, which is referred to for the operation of the first injection valve, is high, the second learning value is updated. That is, the second learning value is updated accurately.

In the above described air-fuel ratio control apparatus, a learning prohibited region, in which update of the first learning value is prohibited, may be provided between two learning regions adjacent to each other in terms of a magnitude of the intake air amount among the learning regions. In each of the learning regions, a representative point, which represents a value of a specific intake air amount in the learning region, may be defined. The learning prohibited region may be wider than a width from a boundary between the learning prohibited region and each of the two learning regions adjacent to the learning prohibited region to the representative point in the learning region. In a case in which the intake air amount is a value between an adjacent pair of the representative points when operating both the first injection valve and the second injection valve, the operation processing section may be configured to operate the first injection valve based on a first learning value obtained through a weighted moving average process of two first learning values in the two learning regions that include the adjacent pair of the representative points. In the weighted moving average process, a weighting coefficient that corresponds to the representative point that is closer to the intake air amount at the time when the first injection valve and the second injection valve are both being operated may be set to be greater than a weighting coefficient that corresponds to the representative point that is farther from the intake air amount. In a case in which the first injection valve and the second injection valve are both being operated, and one of the two learning regions corresponding to the two first learning values used in the weighted moving average process includes the intake air amount at the time, the second updating section may be configured to update the second learning value in the one of the learning regions if conditions are satisfied that include a condition that the first learning value in at least the one of the learning regions has converged.

In the above described configuration, the two adjacent learning regions are separated by the learning prohibited region having the above mentioned width. Therefore, when the current intake air amount is included in the predetermined learning region, and the first learning value, which is used for operating the first injection valve, is a weighted moving average value of the first learning value of the predetermined learning region and the first learning value of the adjacent learning region, the weighting coefficient of the first learning value of the predetermined learning region greater. Thus, even if the first learning value used for operating the first injection valve does not coincide with the first learning value of the predetermined learning region due to the weighted moving average process on the first learning value of the predetermined learning region and the first learning value of the adjacent learning region, the influence of the first learning value of the adjacent learning region is small. Therefore, the accuracy of the update of the second learning value is not reduced even if the conditions that have to be satisfied for updating the second learning value do not include the condition that the first learning value of the adjacent learning region has converged. Moreover, since the second learning value can be updated irrespective of whether the first learning value of the adjacent learning region has converged, the opportunities to update the second learning value are increased.

The above described air-fuel ratio control may include a second determining section configured to, when the second updating section is updating the second learning value, determine that the second learning value has converged on condition that a correction ratio of the base injection amount, which is obtained using the feedback operation amount, is less than or equal to the predetermined ratio. The second updating section is configured to update the second learning value based on the feedback operation amount even when the operation processing section is operating only the second injection valve. Also, The second updating section is configured to, when the operation processing section is operating only the second injection valve, update the second learning value irrespective of whether the second learning value is determined to have converged. Further, the second updating section is configured to, when the operation processing section is operating both the first injection valve and the second injection valve, refrain from updating the second learning value if the second learning value is determined to have converged.

When both the first injection valve and the second injection valve are being operated, the correction ratio for the base injection amount obtained using the feedback operation amount may become greater than zero due to causes that include the first learning value. Therefore, in the above described configuration, unlike the case in which only the second injection valve is operated, when both the first injection valve and the second injection valve are operated, the update of the second learning value by the second updating section is permitted only when the correction ratio of the base injection amount obtained using the feedback operation amount is relatively great. This restrains the second learning value from being updated to an inappropriate value when both the first injection valve and the second injection valve are operated.

To achieve the foregoing objective, an air-fuel ratio control method for an internal combustion engine is provided. The engine includes a first injection valve, which is one of a port injection valve that injects fuel into an intake passage and a direct injection valve that injects fuel into a combustion chamber, and a second injection valve, which is the other. The air-fuel ratio control method includes: setting a base injection amount, which is an open-loop operation amount for controlling an air-fuel ratio to a target value; calculating a feedback operation amount for controlling a detection value of the air-fuel ratio to the target value; performing, to supply fuel to the combustion chamber of the engine, at least one of an operation of the first injection valve based on the base injection amount that has been corrected using the feedback operation amount and a first learning value, and an operation of the second injection valve based on the base injection amount that has been corrected using the feedback operation amount and a second learning value; updating the first learning value based on the feedback operation amount when only the first injection valve is being operated; and when the first learning value is being updated, determining that the first learning value has converged on condition that a correction ratio of the base injection amount, which is obtained using the feedback operation amount, is less than or equal to a predetermined ratio. The method further includes, when the first injection valve and the second injection valve are both being operated: updating the second learning value based on the feedback operation amount on condition that the first learning value is determined to have converged and an injection distribution ratio, which is a ratio of an injection amount of the second injection valve to a total injection amount of the first injection valve and the second injection valve, is greater than or equal to a specified value; and refraining from updating the second learning value when the injection distribution ratio is less than the specified value.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

An air-fuel ratio control apparatus for an internal combustion engine according to one embodiment will now be described with reference to the drawings.

Figure 1:
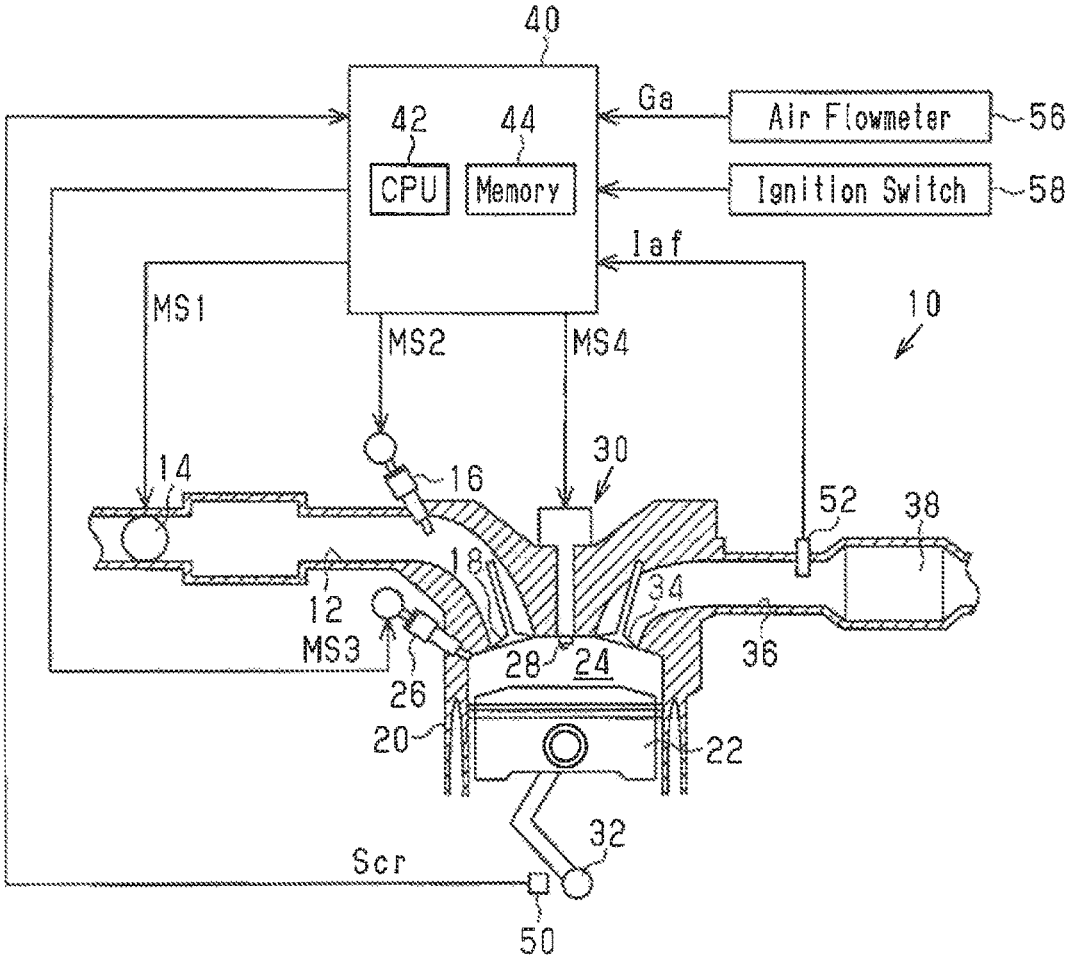
FIG. 1 is a diagram of an internal combustion engine and an air-fuel ratio control apparatus according to one embodiment.

An intake passage 12 of an internal combustion engine 10 shown in FIG. 1 is provided with an electronically controlled throttle valve 14 for varying the cross-sectional area of the flow Passage. The intake passage 12 incorporates a port injection valve 16 for injecting fuel to the intake port. The port injection valve 16 is located downstream of the throttle valve 14. The air in the intake passage 12 and the fuel injected from the port injection valve 16 fill a combustion chamber 24, which is defined by a cylinder 20 and a piston 22, in accordance with an opening operation of an intake valve 18. A direct injection valve 26 injects fuel into the combustion chamber 24. A spark plug 28 of an igniter 30 protrudes into the combustion chamber 24. Then, by spark ignition of the spark plug 28, the air-fuel mixture is ignited and burned. Some of the combustion energy of the air-fuel mixture is converted into rotational energy of a crankshaft 32 by reciprocating motion of the piston 22 along the wall surface of the cylinder 20. Although only one cylinder 20 is shown in FIG. 1, the internal combustion engine 10 typically includes a plurality of cylinders 20.

The exhaust gas generated by the combustion of the air-fuel mixture is discharged to an exhaust passage 36 in accordance with an opening operation of an exhaust valve 34. A catalyst 38 such as a three-way catalyst is provided in the exhaust passage 36.

A control apparatus 40 controls the internal combustion engine 10 and operates actuators such as the port injection valve 16, the direct injection valve 26, the igniter 30, and the like to control mounts (torque, exhaust constituents). For the above-mentioned control, the control apparatus 40 receives output values of various sensors such as a crank angle sensor 50 that detects the rotation angle of the crankshaft 32, an air-fuel ratio sensor 52 that detects the air-fuel ratio, and an air flowmeter 56 that detects an intake air amount Ga. The air-fuel ratio sensor 52 is provided in the exhaust passage 36 on the upstream side of the catalyst 38, and outputs an output value Iaf corresponding to the exhaust constituents in the exhaust passage 36.

On condition that an ignition switch 58 is in the ON state, the control apparatus 40 causes the port injection valve 16 and the direct injection valve 26 to inject fuel to control the above-mentioned control amounts. More specifically, the control apparatus 40 variably sets the ratio (the injection distribution ratio Kpfi) of the amount of fuel injected from the port injection valve 16 to the total amount of fuel injected from both the port injection valve 16 and the direct injection valve 26, and executes fuel injection from at least one of the port injection valve 16 and the direct injection valve 26.

Figure 2:
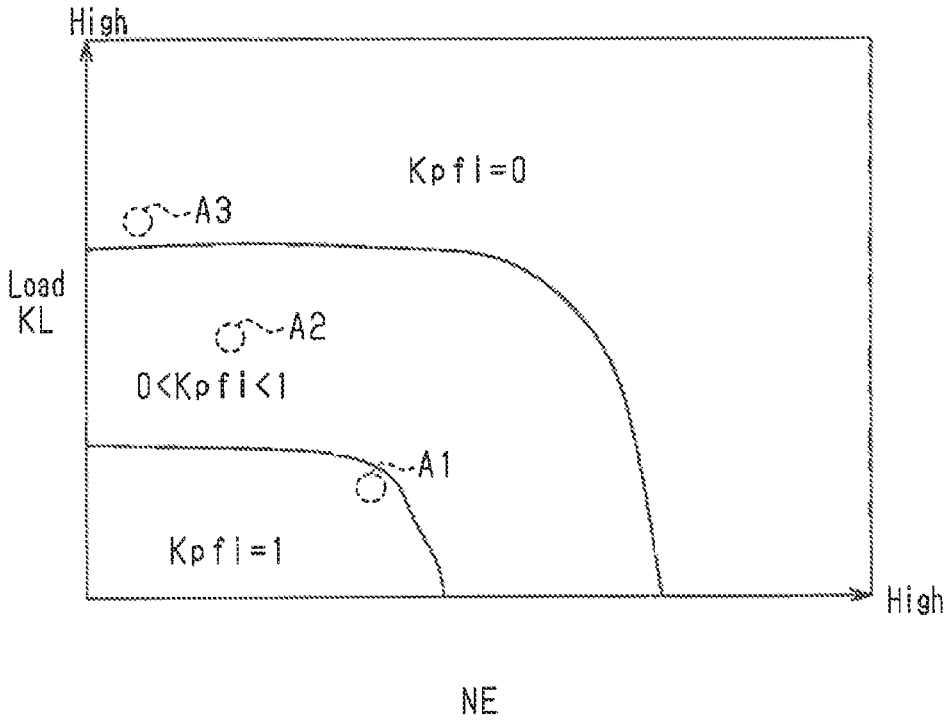
FIG. 2 is a diagram showing regions of the port injection and the direct injection according to the embodiment.

FIG. 2 shows the setting at the operating points of the basic injection distribution ratio Kpfi in the present embodiment. The operating points are determined by the rotation speed NE and the load KL. As shown in FIG. 2, in the present embodiment, the fuel injection using only the port injection valve 16 is executed by setting the injection distribution ratio Kpfi to 1 mainly in the low load region. In the medium load region, the injection distribution ratio Kpfi is set to a value smaller than 1 and greater than 0, so that fuel injection is executed using both the port injection valve 16 and the direct injection valve 26. Further, in the high load region, the injection distribution ratio Kpfi is set to 0, and fuel injection is executed using only the direct injection valve 26. The reason why the injection distribution ratio Kpfi is made small in the high load region or the like to increase the proportion of the fuel injected from the direct injection valve 26 is to increase the amount of fuel vaporized in the combustion chamber 24, thereby lowering the temperature of the air-fuel mixture used for combustion in the combustion chamber 24. The regions A1 to A3 in FIG. 2 will be discussed below.

Figure 3:
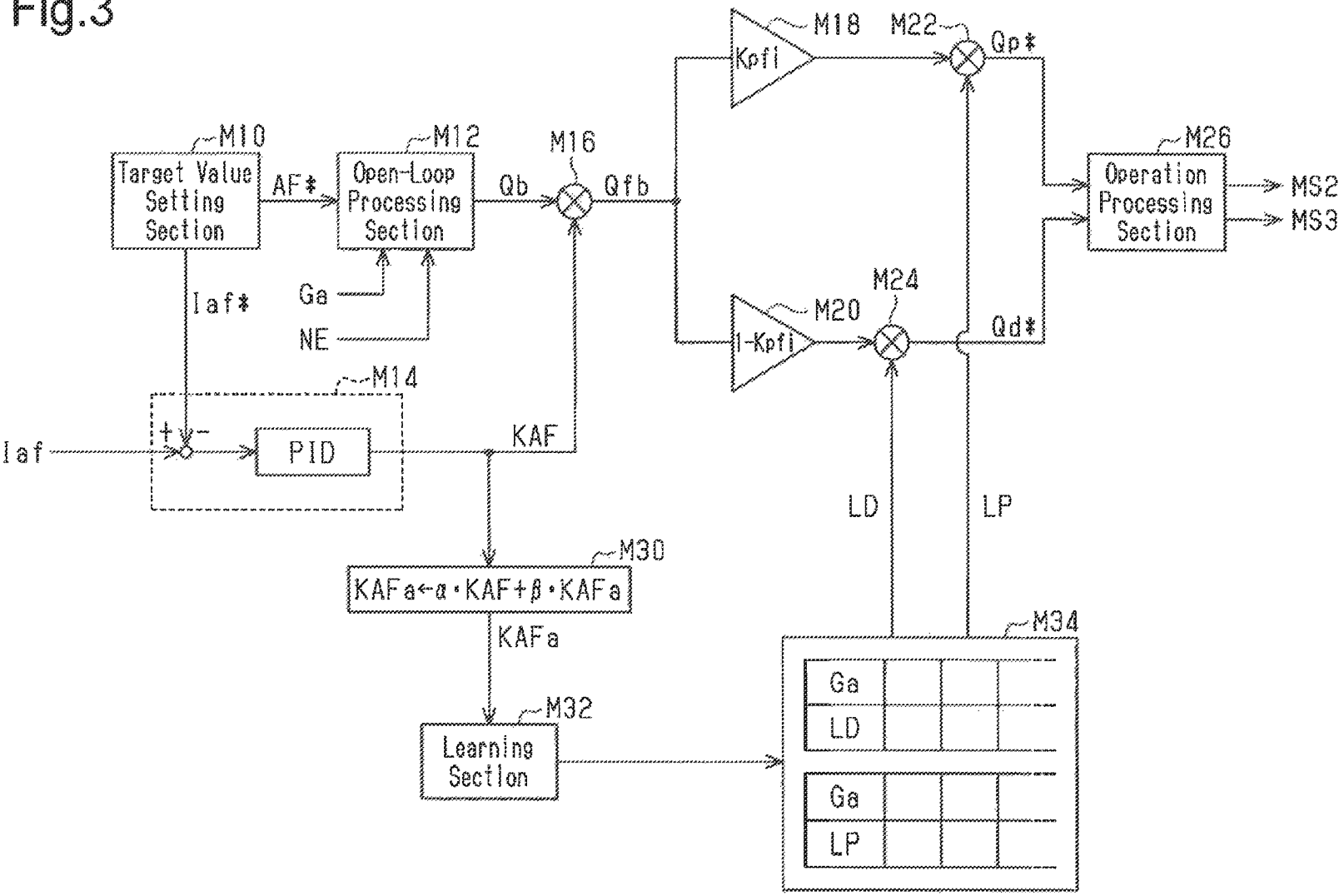
FIG. 3 is an explanatory block diagram showing air-fuel ratio control according to the embodiment.

The control apparatus 40 includes a central processing unit (CPU 42) and a memory 44, and executes the above mentioned control by executing programs stored in the memory 44 using the CPU 42. FIG. 3 shows part of the processing executed by the CPU 42 according to programs stored in the memory 44.

A target value setting section. M10 sets a target value AF* for the air-fuel ratio of the air-fuel mixture to be burned in the combustion chamber 24 and a target value Iaf* for the output value Iaf of the air-fuel ratio sensor 52 that corresponds to the target value AF*.

An open-loop processing section M12 calculates a base injection amount Qb as an open loop operation amount for controlling the air-fuel ratio in the combustion chamber 24 to the target value AF* based on the target value AF*. More specifically, the open-loop processing section M12 calculates the base injection amount Qb based on the target value AF* and the amount of air drawn into the combustion chamber 24 (cylinder filling air amount), which is defined in accordance with the intake air amount Ga and the rotation speed NE. The rotation speed NE is calculated based on an output signal Scr of the crank angle sensor 50. The load shown in FIG. 2 indicates the ratio of the actual cylinder filling air amount to the maximum value of the cylinder filling air amount when the rotation speed NE is given.

A feedback processing section M14 calculates a feedback operation amount KAF for controlling the output value Iaf to the target value Iaf*. Specifically, the feedback processing section M14 includes a proportional element, an integral element, and a differential element, each of which receives a value obtained by subtracting the target value Iaf* from the output value Iaf. The feedback processing section M14 calculates the feedback operation amount KAF based on the sum of the output values of these elements. In the present embodiment, the feedback operation amount KAF is a parameter expressing the correction ratio of the base injection amount Qb, and the correction ratio is 0 when the feedback operation amount KAF is 1.

At the time of executing the feedback control in which the feedback processing section M14 is operating, a multiplication section M16 multiplies the base injection amount Qb by the feedback operation amount KAF to calculate a corrected injection amount Qfb, which is the base injection amount Qb corrected with the feedback operation amount KAF, and outputs corrected injection amount Qfb.

A first distribution ratio multiplication section M18 outputs a value obtained by multiplying the corrected injection amount Qfb by the injection distribution ratio Kpfi In contrast, a second distribution ratio multiplication section M20 outputs a value obtained by multiplying the corrected injection amount Qfb by (1−Kpfi).

The port injection-side learning correction section M22 corrects the output value of the first distribution ratio multiplication section M18 by multiplying the output value by a learning value LP for the port injection valve 16 and outputs the result as a command injection amount Qp* for the port injection valve 16. The learning value LP for the port injection valve 16 will hereinafter be referred to as a port injection learning value LP. The direct injection-side learning correction section M24 corrects the output value of the second distribution ratio multiplication section M20 by multiplying the output value by a learning value LD for the direct injection valve 26 and outputs the result as a command injection amount Qd* for the direct injection valve 26. The learning value LD for the direct injection valve 26 will hereinafter be referred to as a direct injection learning value LD. When the feedback control is stopped, the multiplication section M16 outputs a value obtained by multiplying the base injection amount Qb by 1 as the corrected injection amount Qfb. In this case, although the corrected injection amount Qfb is the base injection amount. Qb itself, the command injection amount Qp* corresponds to the value obtained by correcting the base injection amount Qb with the port injection learning value LP, and the command injection amount Qd* corresponds to the value obtained by correcting the base injection amount Qb with the direct injection learning value LD.

Based on the command injection amount Qp*, the operation processing section M26 generates an operation signal MS2 for the port injection valve 16 and outputs it to the port injection valve 16. Also, based on the command injection amount Qd*, the operation processing section M26 generates an operation signal MS3 for the direct injection valve 26 and outputs to the direct injection valve 26.

An average operation amount calculation section M30 calculates the average value of the feedback operation amount KAF (an average operation amount KAFa). In the present embodiment, a weighted moving average process is illustrated. That is, the updated average operation amount KAFa is set to the sum of the value obtained by multiplying, by a coefficient $\alpha$, the feedback operation amount KAF at the update timing of the average operation amount KAFa and the value obtained by multiplying, by a coefficient $\beta$, the average operation amount KAFa held immediately before the update timing. In the present embodiment, the following expressions are satisfied: $0<\alpha<\beta<1$, $\alpha+\beta=1$.

A learning section M32 receives the average operation amount KAFa and updates the port injection learning value LP and the direct injection learning value LD.

Figure 4:
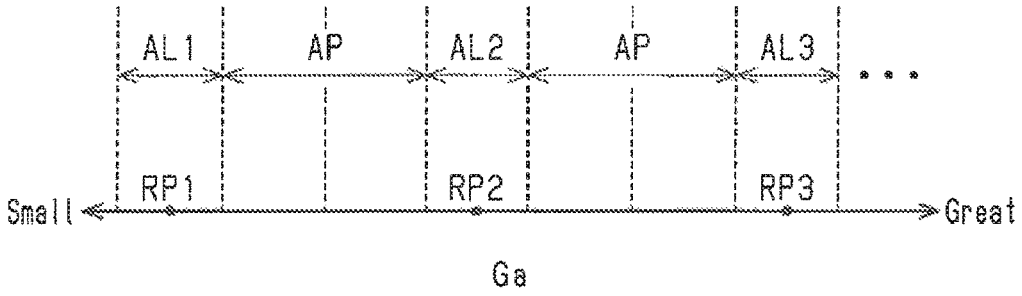
FIG. 4 is a diagram showing learning regions and representative points of the embodiment.

A learning value calculation section M34 calculates the learning values LP and LD and outputs these values to the port injection-side learning correction section M22 and the direct injection-side learning correction section M24, respectively. In the present embodiment, both the learning values LP and LD are determined for each of a plurality of learning regions defined according to the intake air amount Ga. Specifically, as shown in FIG. 4, common learning regions AL1, AL2, AL3, . . . , are defined for the learning values LP and LD. Although the learning region AL1 and the learning region AL2 are adjacent to each other in terms of the magnitude of the intake air amount Ga, a learning prohibited region AP of which the intake air amount Ga is greater than that in the learning region AL1 and smaller than that in the learning region AL2 is arranged between the learning region AL1 and the learning region AL2. The learning prohibited region AP is a region where update of the learning values LP and LD is prohibited. Similarly, a learning prohibited region AP is arranged between the learning region AL2 and the learning region AL3, which are adjacent to each other in terms of the magnitude of the intake air amount Ga. As described above, in the present embodiment, a learning prohibited region AP is arranged between each learning region ALi and a learning region ALj (j=i+1), which are adjacent to each other. In the present embodiment, the learning prohibited region AP, which is sandwiched between the adjacent learning regions ALi and ALj, is wider than the learning regions ALi and ALj. The width of a region is the difference in the intake air amount between the two boundaries (lower limit and upper limit) of the region.

On condition that the intake air amount Ga is included in any of the learning regions AL1, AL2, AL3, . . . , the learning section M32 updates the learning values LP(i), LD(i) in the learning region ALi that includes the intake air amount Ga. In contrast, when the intake air amount Ga is not included in any of the learning regions AL1, AL2, AL3, . . . , the learning section M32 does not update the learning values LP(j), LD(j) in any of the learning regions ALj (j 1, 2, 3, . . . ). In this description, when collectively referring to or not identifying the learning values LP(1), LP(2), LP(3), . . . and the learning values LD(1), LD (2), LD(3), . . . , which correspond to the learning regions AL1, AL2, AL3, . . . , and when referring to the output values of the learning value calculation section M34, these values will be simply represented by the learning values LP, LD.

The learning value calculation section M34 defines representative points RP1, RP2, RP3, . . . in the learning regions AL1, AL2, AL3, . . . , respectively. The representative points RP1, RP2, RP3, . . . have values of the intake air amount Ga at the center of the corresponding learning regions AL1, AL2, AL3, . . . . Then, the learning value calculation section M34 assumes the learning values LP(i), LD(i) updated in the learning region ALi (i=1, 2, 3, . . . ) to be the values at the representative point RPi. Then, when the intake air amount Ga does not coincide with any of the representative points RP1, RP2, RP3, . . . , the learning value calculation section M34 calculates and outputs a learning value LP (LD) by weighted moving average process of the learning values at two representative points RPi, RPj (j=i+1), which are adjacent to the intake air amount Ga.

Figure 5:
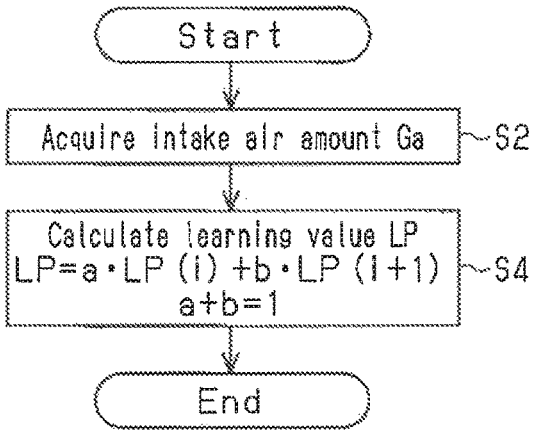
FIG. 5 is a flowchart showing a procedure of learning value calculation process executed by the air-fuel ratio control apparatus of FIG. 1.

FIG. 5 shows the procedure of the calculation process of the port inject ion learning value LP executed by the learning value calculation section M34. The process shown in FIG. 5 is repeatedly executed at a predetermined interval. In the following description, the CPU 42 is described as the subject of the process. The procedure for calculating the direct injection learning value LD performed by the learning value calculation section M34 is also similar to that shown in FIG. 5, so that the explanation using diagrams will be omitted.

In the series of processes shown in FIG. 5, the CPU 42 first acquires the intake air amount Ga (S2). Next, the CPU 42 calculates the port injection learning value LP through the weighted moving average process based on the following expression (c1) at S4.

$$LP=a\cdot LP(i)+b\cdot LP(i+1) \quad \text{(c1)}$$

The representative point RPi related to the port injection learning value LP(i) is less than or equal to the intake air amount Ga acquired in step S2, and the representative point RPj (j=i+1) related to the port injection learning value LP (i+1) is greater than or equal to the intake air amount Ga. The weighting coefficients a and b are both zero or greater, and satisfy (a+b=1). The smaller the difference between the intake air amount Ga acquired at step S2 and the representative point RPi, the greater the weighting coefficient a is set to be. In particular, when the intake air amount Ga and the representative point RPi coincide with each other, the weighting coefficient a is set to 1. In contrast, the smaller the difference between the intake air amount Ga acquired at step S2 and the representative point RPj, the greater the weighting coefficient b is set to be. In particular, when the intake air amount Ga and the representative point RPj coincide with each other, the weighting coefficient b is set to 1.

When step S4 is completed, the CPU 42 temporarily ends the series of processes shown in FIG. 5. When the intake air amount Ga acquired in step S2 is not sandwiched between two adjacent representative points RPi and RPj, the final port injection learning value LP is preferably set to, for example, the port injection learning value LP(i) corresponding to the representative point RPi closest to the intake air amount Ga.

Figure 6:
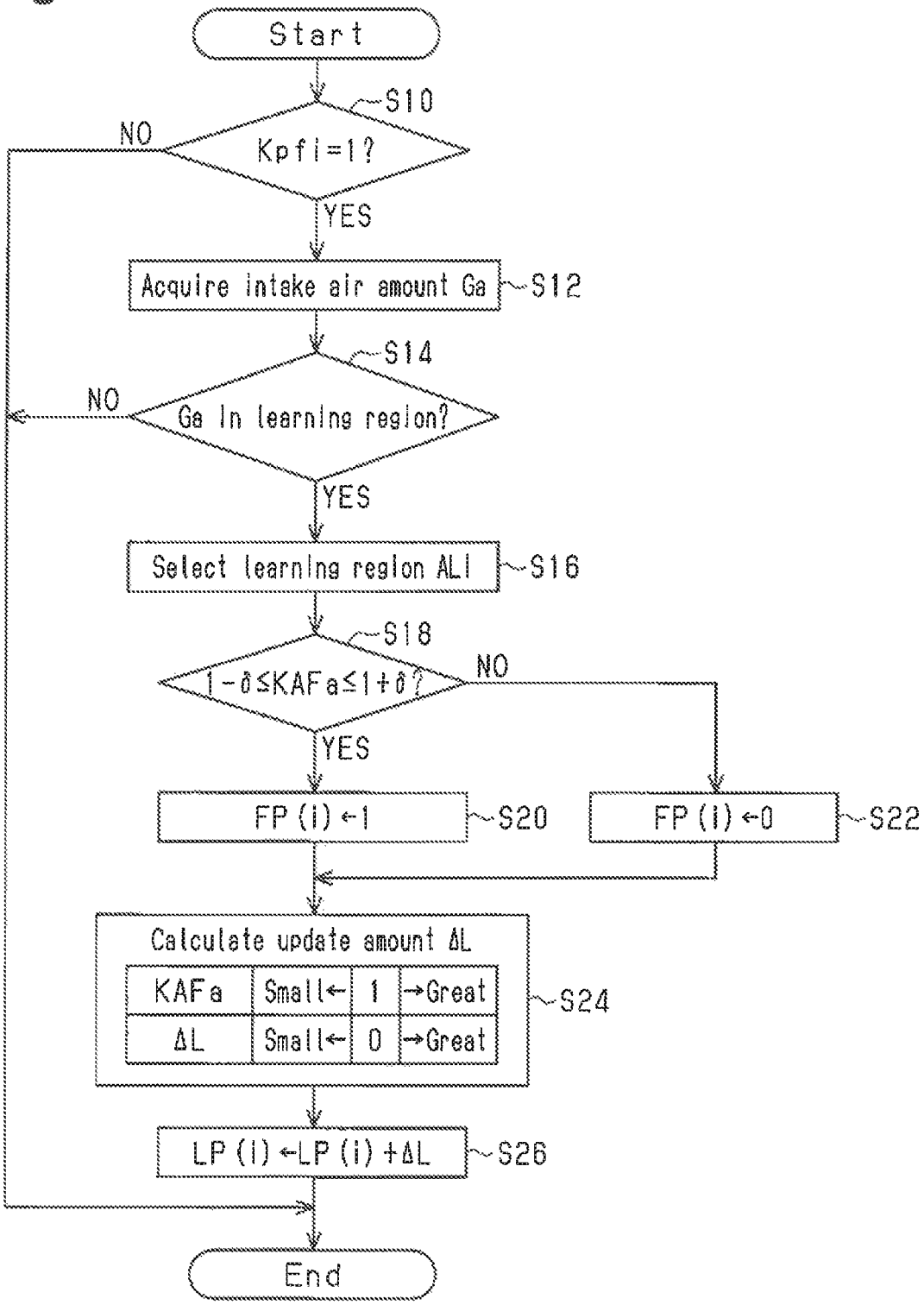
FIG. 6 is a flowchart showing a procedure of a learning process for the port injection valve executed by the air-fuel ratio control apparatus of FIG. 1.

FIG. 6 shows the procedure of process relating to the port injection learning value LP among the processes executed by the learning processing section M32. The process shown in FIG. 6 is a process of updating the port injection learning value LP when fuel is injected only from the port injection valve 16, and is repeatedly executed at a predetermined interval, for example. In the following description, the CPU 42 is described as the subject of the process.

In the series of processes shown in FIG. 6, the CPU 42 first determines whether the injection distribution ratio Kpfi is 1 (S10). When determining that the injection distribution ratio Kpfi is 1 (S10: YES), that is, when determining that fuel is injected only from the port inject valve 16, the CPU acquires the intake air amount Ga (S12). Next, the CPU 42 determines whether the intake air amount Ga is included in any of the learning regions AL1, AL2, AL3, (S14). Then, when determining that the intake air amount Ga is included in any of the learning regions (S14: YES), the CPU 42 selects the learning region ALi including the intake air amount Ga (S16).

Next, the CPU 42 determines whether the average operation amount KAFa is greater than or equal to (1−δ) and less than or equal to (1+δ) at S18. In other words, the CPU 42 determines whether the correction ratio (an absolute value) of the base injection amount Qb obtained using the average operation amount KAFa is less than or equal to a predetermined ratio δ. The correction ratio is defined by the absolute value of (KAFa−1) independently of the value of the base injection amount Qb. This process determines whether the port injection learning value LP(i) has converged to an appropriate value that compensates for an error that may occur when the air-fuel ratio is controlled to the target value AF* using the base injection amount Qb. That is, when the port injection learning value LP(i) converges to an appropriate value, the value obtained by correcting the base injection amount Qb based on the port injection learning value LP(i) approaches an optimum value for controlling the output value Iaf of the air-fuel ratio sensor 52 to the target value Iaf*. Thus, the feedback operation amount KAF approaches 1, and eventually the average operation amount KAFa approaches 1.

Even if the intake air amount Ga is included in the learning region ALi, the port injection learning value LP used for correcting the base injection amount Qb is not necessarily the port injection learning value LP(i) itself in the learning region ALi. The port injection learning value LP may be a value obtained by a weighted moving average process of the port injection learning value LP(i) in the learning region ALi and the port injection learning value LP(j) in the learning region ALj adjacent to the learning region ALi (see step S4 in FIG. 5). However, since the learning prohibited region AP is provided between the learning region ALi and the learning region ALj, when the intake air amount Ga is included in the learning region ALi, the influence of the port injection learning value LP(i) in the learning region ALi is dominant in the port injection learning value LP used for correcting the base injection amount Qb. Specifically, since the difference between the intake air amount Ga and the representative point RPj is greater than the difference between the intake air amount Ga and the representative point RPi, the weighting coefficient for the port injection learning value LP(i) related to the representative point RPi (the weighting coefficient a in the above expression c1) is greater than the weighting coefficient for the port injection learning value LP(j) (the weighting coefficient b in the expression c1) related to the representative point RPj. Thus, in the port injection learning value LP used for correcting the base injection amount Qb, the influence of the port injection learning value LP(i) becomes dominant. Therefore, in the present embodiment, when the average operation amount KAFa approaches 1, it is determined that the port injection learning value LP(i) has converged to an appropriate value.

When determining that the average operation amount KAFa is greater than or equal to (1−δ) and less than or equal to (1+δ) (S18: YES), the CPU 42 sets, to 1, a convergence determination flag FP(i) indicating that the port injection learning value LP(i) in the learning region ALi has converged (S20). In contrast, when determining that the average operation amount KAFa is less than (1−δ) or greater than (1+δ) (S18: NO), the CPU 42 sets the convergence determination flag FP (i) to 0 (S22).

When steps S20 and S22 are completed, the CPU 42 calculates an update amount ΔL of the port injection learning value LP based on the average operation amount KAFa (S24). The update amount ΔL is set to a value for reducing the correction ratio of the base injection amount Qb obtained using the feedback operation amount KAF. More specifically, the CPU 42 sets the update amount ΔL to a greater value as the average operation amount KAFa is increased, sets the update amount ΔL to a smaller value as the average operation amount KAFa is reduced, and sets the update amount ΔL to zero when the average operation amount KAFa is 1. This configuration is achieved by storing in the memory 44 a map that defines the relationship between the average operation amount KAFa and the update amount ΔL in advance, and calculating the update amount ΔL using the map. Then, the CPU 42 updates the port injection learning value LP(i) by adding the update amount ΔL to the port injection learning value LP(i) in the learning region ALi (S26).

In the case where step S26 is completed or when the determination is negative at steps S10 or S14, the CPU 42 temporarily ends the series of processes shown in FIG. 6.

Figure 7:
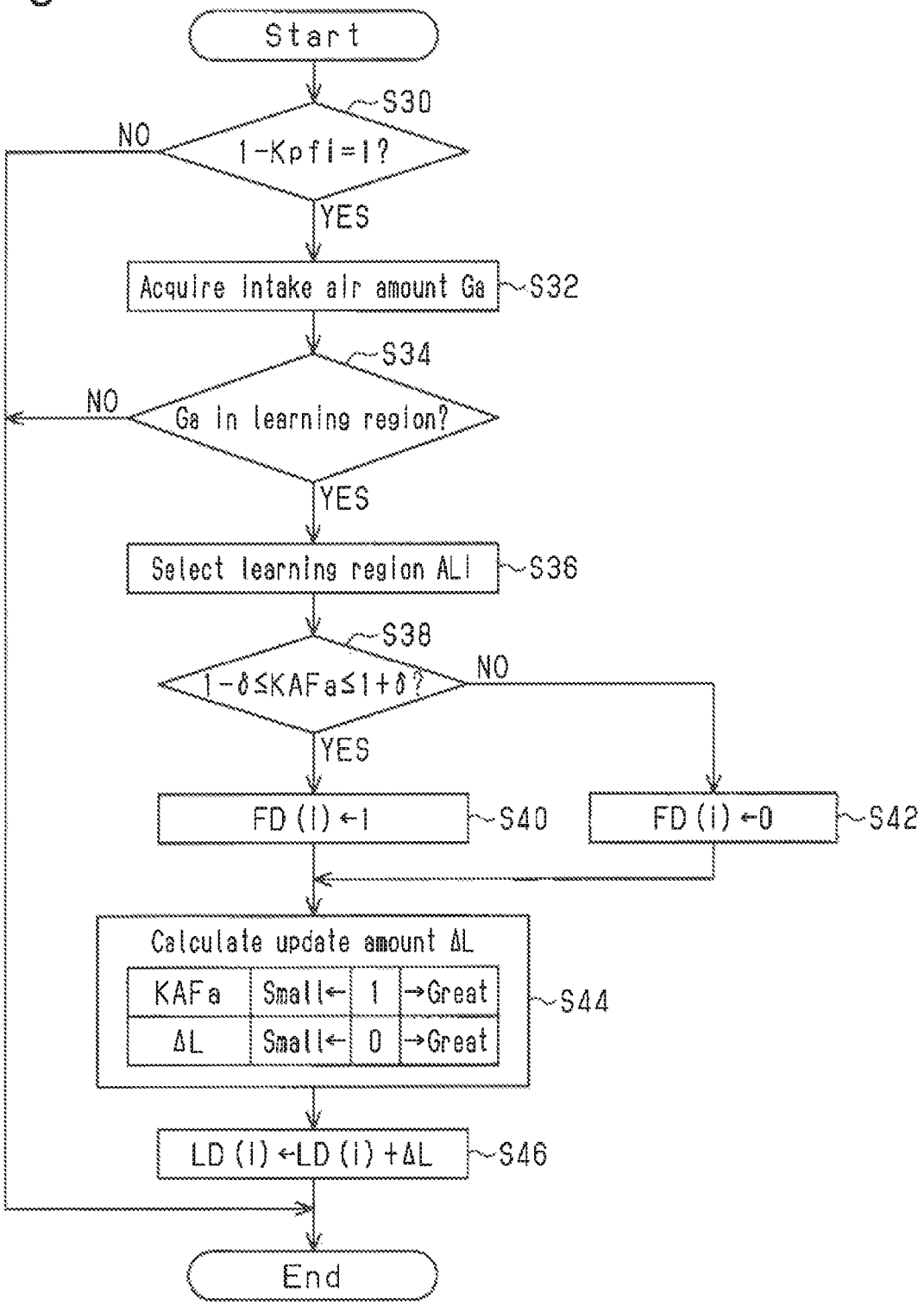
FIG. 7 is a flowchart showing a procedure of a learning process for the direct injection valve executed by the air-fuel ratio control apparatus of FIG. 1.

FIG. 7 shows the procedure of process relating to the direct injection learning value LD among the processes executed by the learning processing section M32. The process shown in FIG. 7 is repeatedly executed at a predetermined interval. In the following description, the CPU 42 is described as the subject of the process.

The process shown in FIG. 7 is a process of updating the direct injection learning value LD when fuel is injected only from the direct injection valve 26, and is in contrast to the process shown in FIG. 6, in which the port injection learning value LP is updated when fuel is injected only from the port injection valve 16. Steps S30 to S46 shown in FIG. 7 correspond to steps S10 to S26 shown in FIG. 6. However, step S30 is a process for determining whether 1 is assigned to the injection distribution ratio (1−Kpfi), which is the ratio of the injection amount of the direct injection valve 26 to the total amount of the injection amount of the port injection valve 16 and the injection amount of the direct injection valve 26. At steps S40 and S42, the value of a convergence determination flag FD(i) indicating that the direct injection learning value LD(i) has converged is set. At step S46, the direct injection learning value LD(i) in the learning region ALi selected at step S36 is updated.

Next, a process of updating the learning values LP and LD when fuel is injected from both the port injection valve 16 and the direct injection valve 26 will be described.

Figure 8:
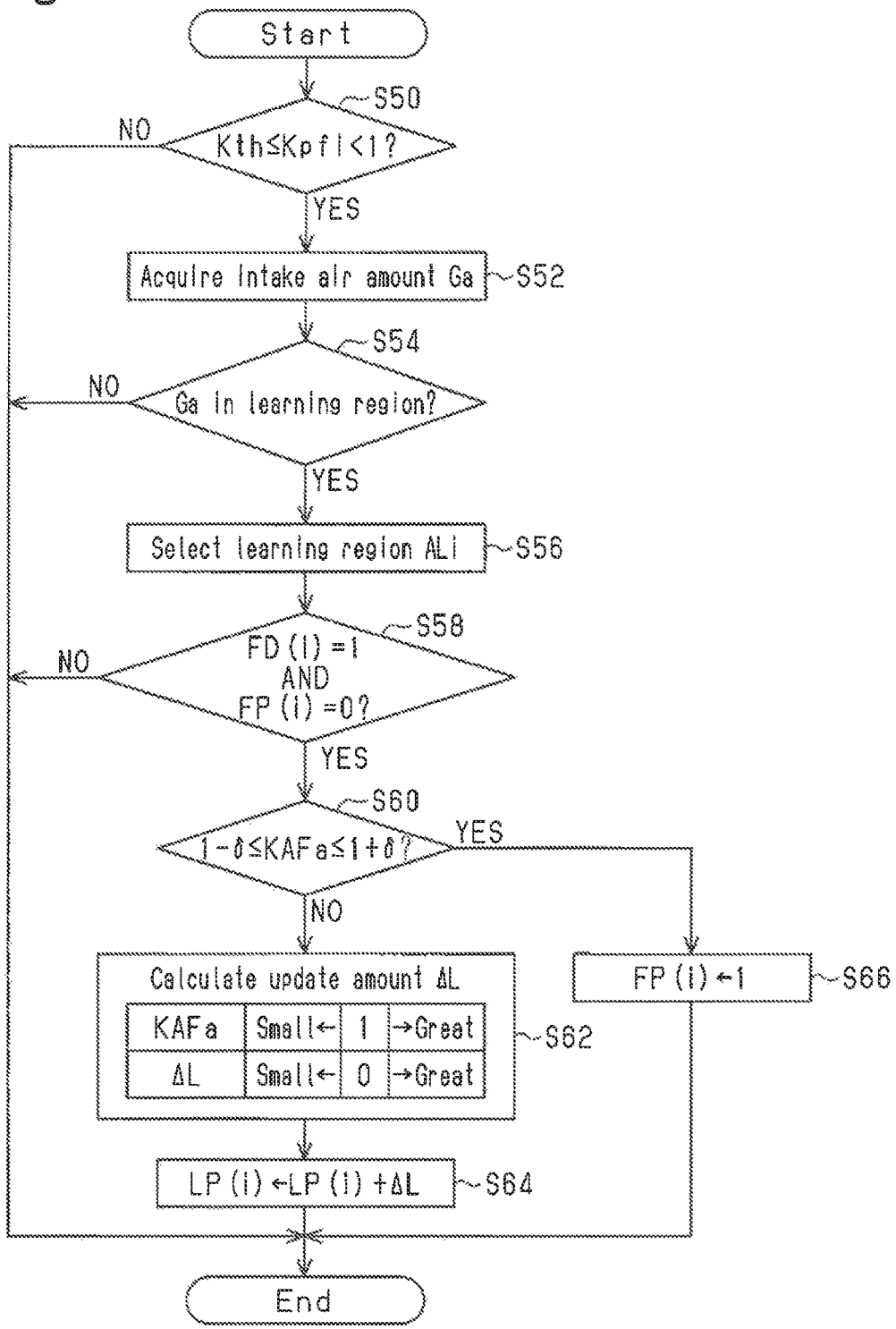
FIG. 8 is a flowchart showing a procedure of learning process for the port injection valve executed by the air-fuel ratio control apparatus of FIG. 1.

FIG. 8 shows the procedure of process relating tc the port injection learning value LP among the processes executed by the learning processing section M32. The process shown in FIG. 8 is a process of updating the port injection learning value LP when the injection amount of the port injection valve 16 is greater than the injection amount of the direct injection valve 26, and is repeatedly executed at a predetermined interval, for example. In the following description, the CPU 42 is described as the subject of the process.

In the series of processes shown in FIG. 8, the CPU 42 first determines whether the injection distribution ratio Kpfi is greater than or equal to a specified value Kth and less than 1 (S50). This process is performed to determine whether one of conditions for executing a process for updating the port injection learning value LP is satisfied when fuel is injected from both the port injection valve 16 and the direct injection valve 26. In the present embodiment, the specified value Kth is set to 0.5. That is, at step S50, it is determined whether the injection amount of the port injection valve 16 is greater than or equal to the injection amount of the direct injection valve 26.

When determining that the injection distribution ratio Kpfi is greater than or equal to the specified value Kth and is less than 1 (S50: YES), the CPU 42 determines that one of the conditions for executing the update process is satisfied, and executes steps S52 to S56, which correspond to steps S12 to S16 shown in FIG. 6. Next, the CPU 42 determines whether the convergence determination flag FD(i) of the direct injection learning value LD(i) related to the learning region ALi selected at step S56 is 1 and the convergence determination flag FP(i) of the port injection learning value LP(i) is 0 (S58).

This condition is used to determine whether one of conditions for executing a process for updating the port injection learning value LP is satisfied when fuel is injected from both the port injection valve 16 and the direct injection valve 26. The situation in which the logical conjunction of the condition that the convergence determination flag FD(i) is 1 and the condition that the injection distribution ratio Kpfi is greater than or equal to the specified value Kth at step S50 is true is a situation in which the direct injection learning value LD(i) has converged and the injection amount of the port injection valve 16 is greater than or equal to the injection amount of the direct injection valve 26. In this situation, when the feedback operation amount KAF deviates from 1, it is considered that the main factor is that the port injection learning value LP has not converged. Therefore, if the determination is affirmative at steps S58, it can be determined that one of the conditions for updating the port injection learning value LP is satisfied.

When affirmative determination is made at step S58, the CPU 42 determines whether the average operation amount KAFa is greater than or equal to (1−δ) and less than or equal (1+δ) as in the case of step S18 of FIG. 6 (S60). When determining that the average operation amount KAFa is less than (1−δ) or greater than (1+δ) (S60: NO), the CPU 42 calculates the update amount ΔL as at step S24 (S62). Then, as at step S26, the CPU 42 updates the port injection learning value LP(i) in the learning region ALi based on the calculated update amount ΔL (S64).

In contrast, when determining that the average operation amount KAFa is greater than or equal to (1−δ) and less than or equal to (1+δ) (S60: YES), the CPU 42 sets the convergence determination flag FP(i) of the port injection learning value LP(i) to 1 (S66).

In the case where steps S64, S66 are completed or when the determination is negative at steps S50, S54, and S58, the CPU 42 temporarily ends the series of processes shown in FIG. 8.

That is, in the present embodiment, when it is determined that the port injection learning value LP has converged while fuel is injected from both the port injection valve 16 and the direct injection valve 26 (S60: YES), the port injection learning value LP is not updated. This is because when fuel is injected from both the port injection valve 16 and the direct injection valve 26, one of the causes of deviation of the average operation amount KAFa (in other words, the feedback operation amount KAF) from 1 is considered to be the direct injection learning value LD. That is, even when it is determined that the direct injection learning value LD has converged (the convergence determination flag FD(i)=1 at step S58), the average operation amount KAFa can deviate from one within the range of ±δ (see S38 in FIG. 7) if the direct injection learning value LD is used and fuel is injected only from the direct injection valve 26. In other words, even when it is determined that the direct injection learning value LD has converged, the direct injection learning value LD has not necessarily completely compensated for the error in the injection amount of the direct injection valve 26. Even in a case in which fuel is injected only from the direct injection valve 26 using the direct injection learning value LD, if the average operation amount KAFa can deviate from within the range ±δ, the direct injection learning value LD is considered to be a cause of deviation of the average operation amount KAFa from 1 within the range of ±δ at step S60 of FIG. 8 when fuel is injection from both the port injection valve 16 and the direct injection valve 26. Therefore, if an affirmative determination is made at step S60 in the situation where it is determined at step S58 of FIG. 8 that the direct injection learning value LD has converged, it cannot be determined which of the direct injection learning value LD and the port injection learning value LP has caused the deviation of the average operation amount KAFa (in other words, the feedback operation amount KAF) from 1. For this reason, in the present embodiment, in the situation where it is determined at step S58 of FIG. 8 that the direct injection learning value LD has converged, if the amount of deviation of the average operation amount KAFa from 1 is within the range of ±δ, the port injection learning value LP is regarded as having converged. Thereafter, the process of updating the port injection learning value LP is not executed. This reduces the possibility of erroneous learning of the port injection learning value LP in the process of FIG. 8, and eventually allows the port injection learning value LP to quickly converge to an appropriate value in the process shown in FIG. 6.

Figure 9:
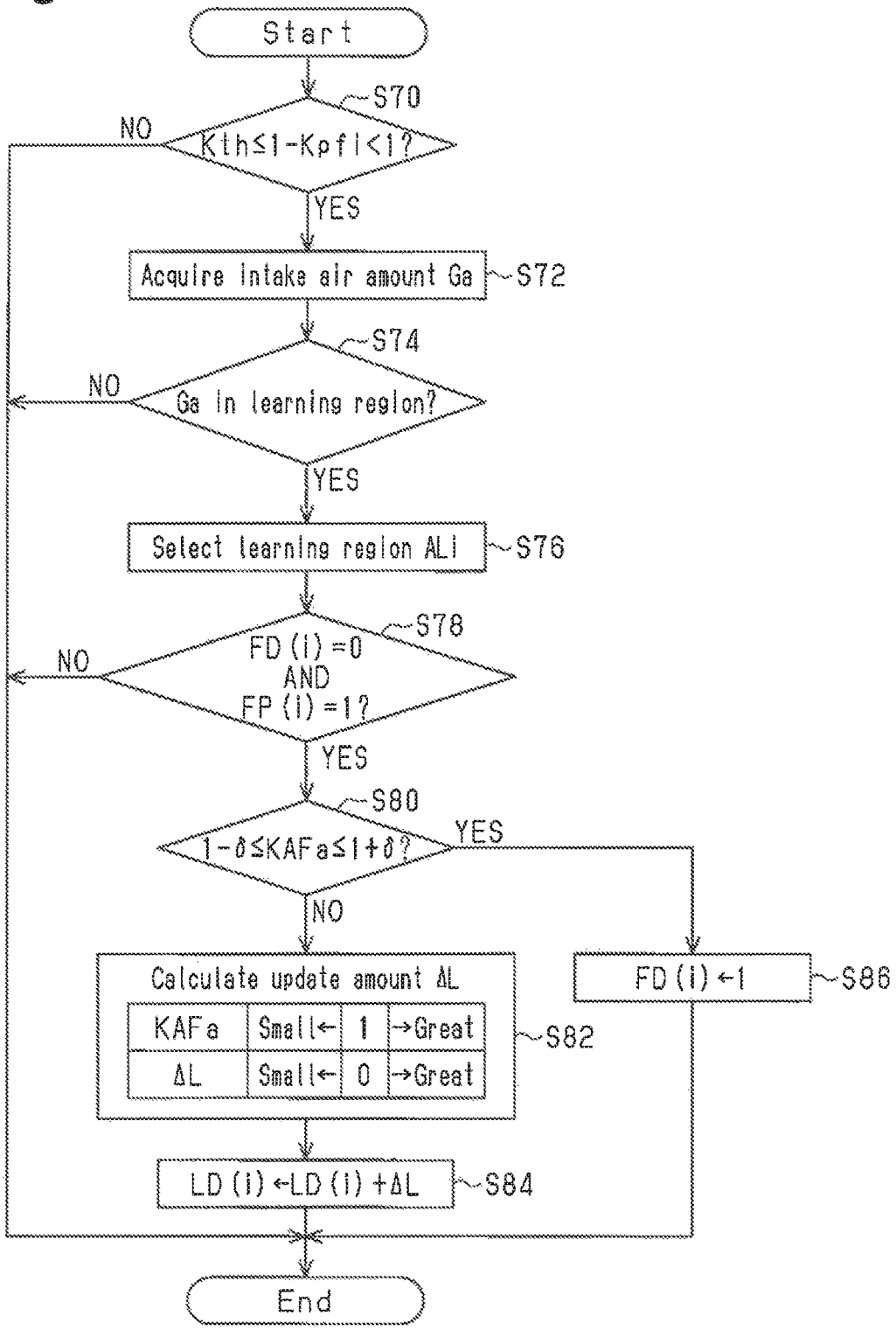
FIG. 9 is a flowchart showing a procedure of a learning process for the direct injection valve executed by the air-fuel ratio control apparatus of FIG. 1.

FIG. 9 shows the procedure of process relating to the direct injection learning value LD among the processes executed by the learning processing section M32. The process shown in FIG. 9 is repeatedly executed at a predetermined interval. In the following description, the CPU 42 is described as the subject of the process.

The process shown in FIG. 9 is a process of updating the direct injection learning value LD when the injection amount of the direct injection valve 26 is greater than or equal to the injection amount of the port injection valve 16. This is in contrast to the process shown in FIG. 8, in which the port injection learning value LP is updated when the injection amount of the port injection valve 16 is greater than or equal to the injection amount of the direct injection valve 26. Steps S70 to S86 shown in FIG. 9 correspond to steps S50 to S66 shown in FIG. 8. However, in step S70, it is determined at step S70 whether the above-mentioned injection distribution ratio (1−Kpfi) is greater than or equal to the specified value Kth and less than 1. In steps S78 and S86, the convergence determination flag FD(i) in steps S58 and S66 is replaced by the convergence determination flag FP(i), and the convergence determination flag FP(i) in steps S58 and S66 is replaced by the convergence determination flag FD (i). At step S84, the direct injection learning value LD(i) in the learning region ALi selected at step S76 is updated (S84).

Also in the update process of the direct injection learning value LD shown in FIG. 9, as in the update process of the port injection learning value LP shown in FIG. 8, the direct injection learning value LD is not updated if it is determined that the direct injection learning value LD has converged (S80: YES). This is because when fuel is injected from both the port injection valve 16 and the direct injection valve 26, one of the causes of deviation of the average operation amount KAFa (in other words, the feedback operation amount KAF) from 1 is considered to be the port injection learning value LP. That is, even when it is determined that the port injection learning value LP has converged (the convergence determination flag FP(i)=1 at step S78), the average operation amount KAFa can deviate from 1 within the range of ±δ (see S18 in FIG. 6) if the port injection learning value LP is used and fuel is injected only from the port injection valve 16. In other words, even when it is determined that the port injection learning value LP has converged, the port injection learning value LP has not necessarily completely compensated for the error in the injection amount of the port injection valve 16. Even in a case in which fuel is injected only from the port injection valve 16 using the port injection learning value LP, if the average operation amount KAFa can deviate from 1 within the range ±δ, the port injection learning value LP is considered to be a cause of deviation of the average operation amount KAFa from 1 within the range of ±δ at step S80 of FIG. 9 when fuel is injection from both the port injection valve 16 and the direct injection valve 26. Therefore, if an affirmative determination is made at step S80 in the situation where it is determined at step S78 of FIG. 9 that the port injection learning value LP has converged, it cannot be determined which of the direct injection learning value LD and the port injection learning value LP has caused the deviation of the average operation amount KAFa (in other words, the feedback operation amount KAF) from 1. For this reason, in the present embodiment, in the situation where it is determined at step S78 of FIG. 9 that the port injection learning value LP has converged, if the amount of deviation of the average operation amount KAFa from 1 is within the range of ±δ, the direct injection learning value LD is regarded as having converged. Thereafter, the process of updating the direct injection learning value LD is not executed. This reduces the possibility of erroneous learning of the direct injection learning value LD in the process of FIG. 9, and eventually allows the direct injection learning value LD to quickly converge to an appropriate value in the process shown in FIG. 7.

In the present embodiment, the CPU 42 initializes the convergence determination flag FP(i) and the convergence determination flag FD(i) to 0 when the ignition switch 58 is switched from the OFF state to the ON state. However, the port injection learning value LP and the direct injection learning value LD in each of the learning regions AL1, AL2, AL3, . . . are used while being maintained to the values when the ignition switch 58 was previously turned ON until the update process is executed.

Operation of the present embodiment will now be described.

Figure 10:
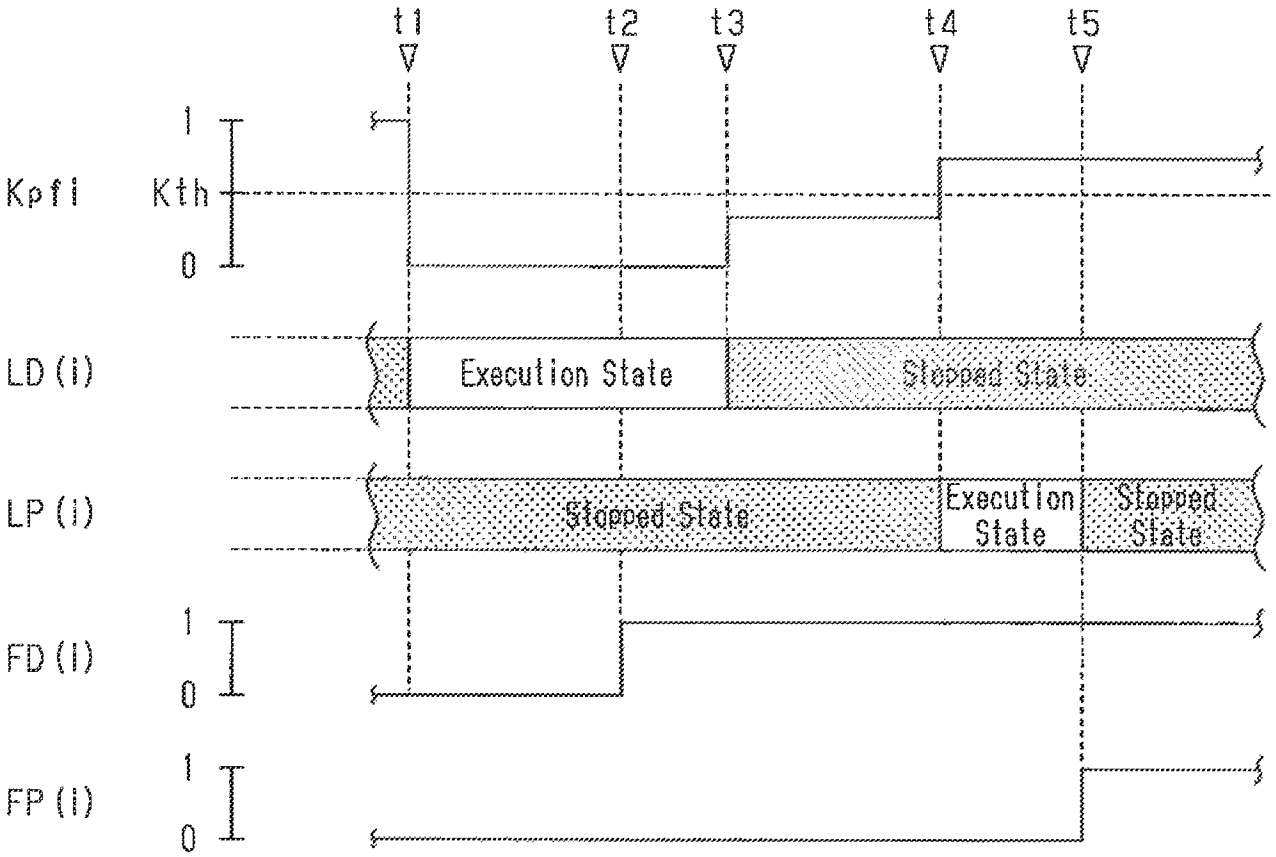
FIG. 10 is a timing diagram illustrating a process of updating a learning value executed by the air-fuel ratio control apparatus of FIG. 1.

FIG. 10 shows transitions of the execution state and the stopped state of the update process of the learning values LD(i), LP(i) in the learning region ALi. In FIG. 10, it is assumed that the learning region ALi does not change after a point in time t1.

As shown in FIG. 10, when the injection distribution ratio Kpfi becomes 0 after the point in time t1, the update process of the direct injection learning value LD(i) is in the execution state, whereas the update process of the port injection learning value LP(i) is in the stopped state. In particular, FIG. 10 shows that the direct injection learning value LD(i) has converged after a point in time t2. Thereafter, when the injection distribution ratio Kpfi becomes greater than zero at a point in time t3, the update process of the direct injection learning value LD(i) is in the stopped state. Further, the update process of the port injection learning value LP(i) remains in the stopped state because the injection distribution ratio Kpfi is less than the specified value Kth. Thereafter, at a point in time t4, the injection distribution ratio Kpfi becomes greater than or equal to the specified value Kth, so that the port injection learning value LP(i) is updated. Then, when the port injection learning value LP(i) is determined to have converged at a point in time t5, the update process of the port injection learning value LP(i) is stopped.

Thus, by updating the port injection learning value LP(i) even when the injection distribution ratio Kpfi is less than 1, the port injection learning value LP(i) is updated more frequently than in a case where the port injection learning value LP(i) is updated only when the injection distribution ratio Kpfi is 1. For example, as shown in FIG. 2, it is assumed that a region A1 in which the injection distribution ratio Kpfi is 1, a region A2 in which the injection distribution ratio Kpfi is less than 1 and greater than zero, and a region A3 in which the injection distribution ratio Kpfi is 0 are all the same learning region ALi. When it is determined that the direct injection learning value LD(i) has converged in the region A3 after the ignition switch 58 is switched to the ON state, it is possible to update the port injection learning value LP(i) in the region A2. Therefore, the port injection learning value LP(i) is updated more frequently than in the case in which the port injection learning value LP(i) is updated only in the region where the injection distribution ratio Kpfi is 1.

Thus, it is possible to converge the port injection learning value LP(i) at an early stage after the ignition switch 58 is switched from the OFF state to the ON state. For this reason, for example, even in the case in which a process is provided that is executed on condition that the port injection learning value LP(i) has converged, it is possible to quickly satisfy that execution condition of the process.

Moreover, when the injection distribution ratio Kpfi is less than 1, the port injection learning value LP(i) is updated on condition that the logical conjunction is true for the condition that the convergence determination flag FD(i) is 1 with respect to the direct injection learning value LD and the condition that the injection distribution ratio Kpfi is greater than or equal to the specified value Kth. Therefore, the port injection learning value LP(i) can be updated accurately when the injection distribution ratio Kpfi is less than 1.

In contrast, after the port injection learning value LP(i) converges in the learning region ALi, the direct injection learning value LD(i) can be updated while fuel is injected from both the port injection valve 16 and the direct injection valve 26 in the learning region ALi. Thus, the direct injection learning value LD(i) is updated more frequently in the learning region ALi. Moreover, when the injection distribution ratio (1−Kpfi) is less than 1, the direct injection learning value LD(i) is updated on condition that the logical conjunction is true for the condition that the convergence determination flag FP(i) of the port injection learning value LP(i) is 1 and the condition that the injection distribution ratio (1−Kpfi) is greater than or equal to the specified value Kth. Therefore, the direct injection learning value LD(i) can be updated accurately when the injection distribution ratio (1−Kpfi) is less than 1.

According to the setting of the injection distribution ratio Kpfi shown in FIG. 2, all of the fuel injection from only the port injection valve 16, the fuel injection from only the direct injection valve 26, and the fuel injection from both the port injection valve 16 and the direct injection valve 26 are not necessarily executed in each of the learning regions AL1, AL2, AL3, . . . . For example, there is a region in which, although fuel injection from only the direct injection valve 26 and fuel injection from both the port injection valve 16 and the direct injection valve 26 are executed, fuel injection from only the port injection valve 16 is not executed. However, even in this case, the port injection learning value LP(j) can be updated through the process shown in FIG. 8. Therefore, even if, for example, an anomaly occurs in the direct injection valve 26, and the injection distribution ratio Kpfi shown in FIG. 2 cannot be maintained, so that fuel injection is executed using only the port injection valve 16, it is possible to use the command injection amount Qp*, which has been calculated using the port injection learning value LP(j), which has already converged from the beginning.

The present embodiment described above further achieves the following advantages.

(1) The condition that the direct injection learning value LD(i) in the learning region ALi has converged is included in the execution condition of the update process of the port injection learning value LP(i) in the learning region ALi. In the learning region ALi, some of the causes of deviation of the feedback operation amount KAF from 1 are related to the direct injection learning value LD. Among these, the main cause is the direct injection learning value LD(i) in the learning region ALi. Thus, since the port injection learning value LP(i) is updated on condition that the direct injection learning value LD(i) in the learning region ALi has converged, the port injection learning value LP(i) is allowed to be updated on condition that the feedback operation amount KAF deviates from 1 by a small degree due to the direct injection learning value LD, which has been used to calculate the command injection amount. Qd*. Therefore, it is possible to update the port injection learning value LP(i) with high accuracy.

Likewise, since the condition that the port injection learning value LP(i) in the learning region ALi has converged is included in the execution conditions of the update process of the direct injection learning value LD in the learning region ALi, it is possible to update the direct injection learning value LD(i) with high accuracy.

(2) The command injection amount Qd* and the command injection amount Qp* are calculated in accordance with the learning values calculated by the weighted moving average process of the learning values in each of the learning regions ALi, ALj. However, in the process of updating the learning value, the condition that the learning value in the learning region ALj has converged is not included in the execution conditions of the update process in the other learning region ALi. In other words, when one of the direct injection learning value and the port injection learning value is defined as a first learning value, and the other is defined as a second learning value, two first learning values are used in the weighted moving average process. On condition that the first learning value in at least one of the learning regions ALi has converged, the second learning value in that learning region ALi is updated. This increase the opportunities of updating the learning values LP(i), LD(i) while restraining the accuracy of the update from being reduced.

(3) When fuel is injected from both the port injection valve 16 and the direct injection valve 26, the conditions for updating the learning values LP, LD include the condition that the correction ratio of the base injection amount Qb, which is obtained using the average operation amount KAFa, is greater than the predetermined ratio δ. This restrains the learning values from being updated to inappropriate values.

(4) When the correction ratio of the base injection amount Qb, which is obtained using the average operation amount KAFa, less than or equal to the predetermined ratio δ, it is determined that the learning values LP and LD have converged. Accordingly, when the correction ratio, which is obtained using the feedback operation amount KAF, suddenly falls below the predetermined ratio erroneous determination of convergence is prevented.

<Correspondence>

When the first injection valve corresponds to the port injection valve 16, a first updating section corresponds to the CPU 42 executing steps S10 to S16, S24, and S26, a first determining section corresponds to the CPU 42 executing steps S18 to S22, and a second updating section corresponds to the CPU 42 executing steps S70 to S78, S82, and S84. When the first in valve corresponds to the direct injection valve 26, the first updating section corresponds to the CPU 42 executing steps S30 to S36, S44, and S46, the first determining section corresponds to the CPU 42 executing steps S38 to S42, and the second updating section corresponds to the CPU 42 executing steps S50 to S58, S62, and S64. The air-fuel ratio control apparatus corresponds to the control apparatus 40.

When the first injection valve corresponds to the port injection valve 16, a second determining section corresponds to the CPU 42 executing steps S80 and S86. When the first injection valve corresponds to the direct injection valve 26, the second determining section corresponds to the CPU 42 executing steps S60 and S66.

Other Embodiments

At least one feature of the above illustrated embodiments may be modified as follows.

Regarding Average Operation Amount Calculation Section M30

The average operation amount calculation section M30 is not limited to the one that executes the weighted moving average process for the feedback operation amount KAF, but may be, for example, a process of calculating a predetermined number of simple moving average values. The predetermined number is preferably ten or greater.

Regarding Gain of Update Amount Calculating Process

The update amount calculating process is not limited to the process in which the more deviated from 1 the average operation amount KAFa, the greater the absolute value of the update amount ΔL of the learning value becomes example, the update amount ΔL may be set to a value obtained by multiplying (KAFa−1) by a predetermined constant that is greater than or equal to zero.

Regarding Input Parameter for Calculating Update Amount ΔL

The input parameter for calculating the update amount ΔL is not limited to the average operation amount KAFa. For example, when the feedback processing section M14 includes an integral element, the input parameter for calculating the update amount ΔL may be an output value of the integral element. In this case, the learning value is preferably permitted to be updated on condition that the fluctuation amount of the out value of the integral element is less than or equal to a predetermined amount.

The update amount ΔL may be calculated in accordance not only with the output value of the integral element, but also to the feedback operation amount KAF at the time.

Regarding Convergence Determination

The determination process as to whether the average value of the correction ratio of the base injection amount Qb, which is obtained using the feedback operation amount KAF, is less than or equal to the predetermined ratio δ is not limited to one based on the average operation amount KAFa. For example, the learning values LP and LD may be determined to have converged when the correction ratio of the base injection amount Qb, which is obtained using the feedback operation amount KAF, has remained less than or equal to the predetermined ratio δ for a predetermined time period. That is, in this case, the average value of the correction ratio of the base injection amount Qb, which is obtained using the feedback operation amount KAF, for the predetermined time period is also less than or equal to the predetermined ratio δ.

Further, for example, the learning values LP, LD may be determined to have converged when the logical conjunction is true for the condition that the correction ratio of the base injection amount Qb, which is obtained using the feedback operation amount KAF, is less than or equal to a specified ratio less than the predetermined ratio δ, and the condition that the fluctuation amount of the feedback operation amount KAF in a predetermined period is less than or equal to a predetermined amount. In this case, the average value of the correction ratio in the predetermined period is set to be less than or equal to the predetermined ratio δ.

Furthermore, the learning values LP, LD do not necessarily determined to have converged through the process that uses the feedback operation amount KAF as an input. For example, the learning values LP, LD may be determined to have converged when the logical conjunction is true for the condition that the correction ratio of the base injection amount Qb, which is obtained using the output value of the integral element of the feedback processing section M14, is less than or equal to a specified ratio that is less than the predetermined ratio δ, and the condition the fluctuation amount of the output value of the integral element in a predetermined period is less than or equal to a predetermined value. That is, when the fluctuation amount of the output value of the integral element is small, the deviation amount from 1 of the output value of the proportional element and the output value of the differential element becomes small. Thus, if the logical conjunction is true, the correction ratio of the base injection amount Qb, which is obtained using the feedback operation amount KAF, is considered to be less than or equal to the predetermined ratio δ.

Regarding Dead Zone

In the above illustrated embodiment, in the air-fuel ratio feedback control, in which both the port injection valve 16 and the direct injection valve 26 are operated, the region in which the average operation amount KAFa is greater than or equal to (1−δ) and less than or equal to (1+δ) is a dead zone, in which the learning values are not updated, but the present invention is not limited thereto. That is, for example, also in the case where an affirmative determination is made at step S60 of FIG. 8, also in the case where steps S62 and S64 are executed or when the result of the determination at step S80 of FIG. 9 is affirmative, steps S82 and S84 may be executed.

The dead zone does not necessarily set during the air-fuel ratio feedback control that operates both the port injection valve 16 and the direct injection valve 26. That is, for example, also in the case where an affirmative determination is made at step S18 of FIG. 6, steps S24, S26 may be skipped. Also, in the case where an affirmative determination is made at steps S44, 46 at step S438 in FIG. 7, the steps S44, S46 may be skipped.

Alternatively, on condition that the correction ratio of the base injection amount Qb is greater than a specified ratio δL, when the injection distribution ratio Kpfi is 1 or 0, the learning values LP and LD may be updated, and the specified ratio δL may be greater than zero and less than the predetermined ratio δ.

Regarding Learning Prohibited Region

The learning prohibited region AP does not necessarily have to be wider than the learning regions ALi and ALj adjacent to each other with the learning prohibited region AP therebetween. For example, the learning prohibited region AP may be wider than the width between the representative point RPi in the learning region ALi and the boundary between the learning region ALi and the learning prohibited region AP or than the width between the representative point RPj in the learning region ALj and the boundary between the learning region ALj and the learning prohibited region AP. In this case, when the learning values LP, LD in the learning region ALi are weighted moving average values of the learning values in the two learning regions ALi, ALj, the value in the learning region ALi is dominant in the learning values LP, LD.

Regarding Learning Region

The regions divided according to the value of the intake air amount Ga do not necessary have to be configured to provide a learning prohibited region between adjacent two regions of different values of the intake air amount. Ga. For example, two adjacent regions of different intake air amounts Ga may be adjacent to each other without a learning prohibited region in between. In this case, for example, when the magnitude of (KAFa−1) is the same, the update gain of the learning value may be increased as the distance between the intake air amount Ga and the representative point RPi is reduced. For example, the update amount ΔL may be increased toward the representative point RPi.

In addition, the learning regions do not necessarily divided based on the intake air amount Ga, but may be divided based on the coolant temperature of the engine 10 and the intake air amount Ga. The learning regions do not necessarily need to be divided based on the intake air amount Ga.

Further, the number of the learning regions does not necessarily need to be plural.

The learning region of the port injection learning value LP and the learning region of the direct injection learning value LD do not need to be identical.

Reflection of Learning Value on Injection Amount

In the above illustrated embodiment, when the actual intake air amount Ga does not coincide with any of the representative points RP, the learning values LD, LP used to calculate the command injection amounts Qp*, Qd* are calculated by the weighted moving average process of the learning values at each of the two representative points RPi, RPj (j=i+1). However, the present invention is not limited to this configuration. For example, if no learning prohibited region is provided as described in the section of "Regarding Learning Region," the command injection amounts Qp*, Qd* may be calculated using, as the learning values LD, LP, the learning values LD(i), LP(i) corresponding to the current learning region ALi. However, even in the case where there is a learning prohibited region, when the intake air amount Ga is in any one of the learning regions ALi, the command injection amounts Qp*, Qd* may be calculated by using the learning values LD(i), LP(i) as the learning values LD, LP without being changed.

Regarding Update Conditions when 0<Kpfi<1

In the above illustrated embodiment, the direct injection learning value LD(i) is updated on condition that the convergence determination flag FP(i) is 1 in the process of FIG. 9. However, the present invention is not limited to this. For example, when the port injection learning value LP is calculated by the weighted moving average process of the port injection learning value LP(i) and the port injection learning value LP(i+1), the direct injection learning value LD(i) may be updated on condition that 1 is assigned to the convergence determination flag FP(i+1), in addition to the convergence determination flag FP(i). Likewise, the port injection learning value LP(i) does not necessarily need to be updated on condition that the convergence determination flag FD(i) is 1 in the process of FIG. 8. For example, when the direct injection learning value LD is calculated through the weighted moving average process of the direct injection learning value LD(i) and the direct injection learning value LD(i+1), the port injection learning value LP(i) may be updated on condition that 1 is assigned to the convergence determination flag FD(i+1) in addition to the convergence determination flag FD(i). This condition setting is particularly effective when the learning prohibited region AP is narrow.

As described in the section of "Regarding Learning Region", when the learning region of the port injection learning value LP and the learning region of the direct injection learning value LD do not coincide with each other, for example, when the injection distribution ratio Kpfi is greater than or equal to the specified value Kth, and the current intake air amount Ga is in the learning region ALi of the port injection learning value LP(i), the following operation is performed. That is, if the current intake air amount Ga is included in the learning region of the direct injection learning value LD(j) of the two direct injection learning values LD(j) and LD(j+1), which are used to calculate the command injection amount Qd*, the condition that the direct injection learning value LD(j) has converged may be a condition for updating the port injection learning value LP(i). Further, if neither the learning region of the direct injection learning value LD(j) nor the learning region of the direct injection learning value LD(j+1) includes the current intake air amount Ga, the condition that the direct injection learning values LD(j) and LD(j+1) both have converged may be a condition for updating the port injection learning value LP(i).

Regarding Injection Distribution Region

The setting of the injection distribution ratio Kpfi is not limited to that shown in FIG. 2. Particularly, the learning regions AL1, AL2, AL3, . . . , do not necessarily include at least one region in which fuel can be injected either only from the port injection valve 16, only from the direct injection valve 26, or both the port injection valve 16 and the direct injection valve 26. For example, in principle, no region may be provided in which the above three injection modes can be selectively performed. Even in this case, for example, in a region in which fuel injection is performed either by the direct injection valve 26 or both the port injection valve 16 and the direct injection valve 26 and in which injection only by the port injection valve 16 is not performed, the port injection learning value LP may be updated when fuel is injected from both the injection valves 16, 26. Thus, in this region, for example, if the fuel injection only from the port injection valve 16 needs to be performed when there is an anomaly in the direct injection valve 26, the controllability of the air-fuel ratio can be maintained high from the beginning.

Regarding Update Process t Injection Distribution

In the above-illustrated embodiment, both the port injection learning value LP and the direct injection learning value LD can be updated when fuel injection is performed from both the port injection valve 16 and the direct injection valve 26. However, the present invention is not limited to this. For example, only the port injection learning value LP may be updated. Alternatively, for example, only the direct injection learning value LD may be updated.

Regarding Feedback Processing Section

Instead of using the sum of the respective output values of the proportional element, the integral element, and the differential element as the feedback operation amount KAF, for example, the sum of the output values of the proportional element and the integral element may be used as the feedback manipulated variable KAF. Also, for example, the output value of the proportional element may be used as the feedback operation amount KAF, or the output value of the integral element may be used as the feedback operation amount KAF.

Regarding Specified Value Kth

In the above illustrated embodiment, the specified value Kth is 0.5, but is not limited to this value. For example, the specified value Kth may be set to a value greater than or equal to 0.4 and less than 0.5, or value greater than 0.5 and less than or equal to 0.6. The specified value Kth does not necessarily need to be a value between 0.4 and 0.6.

Regarding Condition for Resetting Convergence Determination

The condition for resetting the history of determination of convergence of the learning values LP, LD is not limited to the condition that the learning values LP, LD are determined to have not converged or the condition that the ignition switch 58 has been switched from the OFF state to the ON state. For example, the condition for resetting the history of determination of convergence of the learning values LP, LD may be the condition that the ignition switch 58 has been switched from the ON state to the OFF state, in place of the condition that the ignition switch has been switched from the OFF state to the ON state.

In addition, for example, in a hybrid vehicle, which is equipped with an internal combustion engine and an electric motor, the condition for resetting the history of determination of convergence of the learning values LP, LD may be the condition that a request for starting the internal combustion engine is made for the first time during a period in which the switch for enabling the hybrid vehicle to travel is ON.

The present invention is not limited to this. For example, replacement of the air flowmeter 56 or the port injection valve 16 may be used as the condition for resetting the history of determination of convergence of the port injection learning values LP. Also, replacement of the air flowmeter 56 or the direct injection valve 26 may be used as the condition for resetting the history of determination of convergence of the direct injection learning values LD. When such a reset condition is provided and there is a learning region ALi in which, for example, fuel injection from only the port injection valve 16 is not performed in principle, the following configuration is preferred. That is, in the process of FIG. 8, when the convergence determination flags FP(i) and FD(i) are both 1, it is preferable to reset the convergence determination flag FP(i) by making the correction ratio of the base injection amount Qb obtained using the average operation amount KAFa greater than the predetermined ratio δ. Further, in the case where there is a learning region in which fuel injection from only the direct injection valve 26 is not performed in principle, the following configuration is desirable. That is, in the process of FIG. 9, when the convergence determination flags FP(i) and FD(i) are both 1, it is preferable to reset the convergence determination flag FD(i) by making the correction ratio of the base injection amount Qb obtained using the average operation amount KAFa greater than the predetermined ratio δ.

Regarding Open-Loop Processing Section

For example, instead of directly using the intake air amount Ga to calculate the base injection amount Qb, the intake air amount Ga may be used only to correct the air model at a steady state, and the base injection amount Qb may be calculated based on the cylinder filling air amount estimated from the air model. In this case, the cylinder filling air amount estimated using the air model is influenced by an error included in the intake air amount Ga, and the error in the air-fuel ratio control caused by the error of the intake air amount Ga is compensated by the learning values LP, LD.

Regarding Control Apparatus

The control apparatus 40 is not limited to the apparatus that includes the CPU 42 and the memory 44, and performs all the above-described processes through software. For example, the control apparatus may include dedicated hardware, such as an application specific integrated circuit (ASIC) that executes at least part of the various processes, for example, the process of the average operation amount calculation section M30. That is, the control apparatus may be circuitry including 1) one or more dedicated hardware circuits such as an ASIC, 2) one or more processors (microcomputers) that operate according to a computer program (software), or 3) a combination thereof.

The invention claimed is:

1. An air-fuel ratio control apparatus for an internal combustion engine, wherein the engine includes a first injection valve, which is one of a port injection valve that injects fuel into an intake passage and a direct injection valve that injects fuel into a combustion chamber, and a second injection valve, which is the other, the air-fuel ratio control apparatus comprising a processor programmed to:

set a base injection amount, which is an open-loop operation amount for controlling an air-fuel ratio to a target value;

calculate a feedback operation amount for controlling a detection value of the air-fuel ratio to the target value;

perform, to supply fuel to the combustion chamber of the engine, at least one of an operation of the first injection valve based on the base injection amount that has been corrected using the feedback operation amount and a first learning value, and an operation of the second injection valve based on the base injection amount that has been corrected using the feedback operation amount and a second learning value;

update the first learning value based on the feedback operation amount when only the first injection valve is being operated;

when the first learning value is being updated, determine that the first learning value has converged to a first appropriate value on condition that a correction ratio of the base injection amount, which is obtained using the feedback operation amount, is less than or equal to a predetermined ratio;

update the second learning value based on the feedback operation amount when both the first injection valve and the second injection valve are being operated;

update the second learning value on condition that the first learning value is determined to have converged to the first appropriate value and an injection distribution ratio, which is a ratio of an injection amount of the second injection valve to a total injection amount of the first injection valve and the second injection valve, is greater than or equal to a specified value; and refrain from updating the second learning value when the injection distribution ratio is less than the specified value.

2. The air-fuel ratio control apparatus for an internal combustion engine according to claim 1, wherein the processor is programmed to:

update the first learning value for each of a plurality of learning regions, which are divided according to values of an intake air amount of the internal combustion engine;

when both the first injection valve and the second injection valve are being operated, operate the first injection valve based on the first learning value in a learning region including the intake air amount at the time; and when the first injection valve and the second injection valve are both being operated, update the second learning value in a learning region including the intake air amount at the time if conditions are satisfied that include a condition that the first learning value in the learning region has converged to the first appropriate value.

3. The air-fuel ratio control apparatus for an internal combustion engine according to claim 2, wherein a learning prohibited region, in which update of the first learning value is prohibited, is provided between two learning regions adjacent to each other in terms of a magnitude of the intake air amount among the learning regions, in each of the learning regions, a representative point, which represents a value of a specific intake air amount in the learning region, is defined, the learning prohibited region is wider than a width from a boundary between the learning prohibited region and each of the two learning regions adjacent to the learning prohibited region to the representative point in the learning region, and the processor is programmed to:

in a case in which the intake air amount is a value between an adjacent pair of the representative points when operating both the first injection valve and the second injection valve, operate the first injection valve based on a first learning value obtained through a weighted moving average process of two first learning values in the two learning regions that include the adjacent pair of the representative points;

in the weighted moving average process, a weighting coefficient that corresponds to the representative point that is closer to the intake air amount at the time when the first injection valve and the second injection valve are both being operated is set to be greater than a weighting coefficient that corresponds to the representative point that is farther from the intake air amount; and in a case in which the first injection valve and the second injection valve are both being operated, and one of the two learning regions corresponding to the two first learning values used in the weighted moving average process includes the intake air amount at the time, update the second learning value in the one of the learning regions if conditions are satisfied that include a condition that the first learning value in at least the one of the learning regions has converged to the first appropriate value.

4. The air-fuel ratio control apparatus for an internal combustion engine according to claim 1, wherein the processor is programmed to:

when the second learning value is being updated, determine that the second learning value has converged to a second appropriate value on condition that a correction ratio of the base injection amount, which is obtained using the feedback operation amount, is less than or equal to the predetermined ratio;

update the second learning value based on the feedback operation amount even when only the second injection valve is being operated;

when only the second injection valve is being operated, update the second learning value irrespective of whether the second learning value is determined to have converged to the second appropriate value; and when both the first injection valve and the second injection valve are being operated, refrain from updating the second learning value if the second learning value is determined to have converged to the second appropriate value.

5. An air-fuel ratio control method for an internal combustion engine, wherein the engine includes a first injection valve, which is one of a port injection valve that injects fuel into an intake passage and a direct injection valve that injects fuel into a combustion chamber, and a second injection valve, which is the other, the air-fuel ratio control method comprising:

setting a base injection amount, which is an open-loop operation amount for controlling an air-fuel ratio to a target value;

calculating a feedback operation amount for controlling a detection value of the air-fuel ratio to the target value;

performing, to supply fuel to the combustion chamber of the engine, at least one of an operation of the first injection valve based on the base injection amount that has been corrected using the feedback operation amount and a first learning value, and an operation of the second injection valve based on the base injection amount that has been corrected using the feedback operation amount and a second learning value;

updating the first learning value based on the feedback operation amount when only the first injection valve is being operated;

when the first learning value is being updated, determining that the first learning value has converged to an appropriate value on condition that a correction ratio of the base injection amount, which is obtained using the feedback operation amount, is less than or equal to a predetermined ratio; and when the first injection valve and the second injection valve are both being operated updating the second learning value based on the feedback operation amount on condition that the first learning value is determined to have converged to the appropriate value and an injection distribution ratio, which is a ratio of an injection amount of the second injection valve to a total injection amount of the first injection valve and the second injection valve, is greater than or equal to a specified value, and refraining from updating the second learning value when the injection distribution ratio is less than the specified value.

6. An air-fuel ratio control apparatus for an internal combustion engine, wherein the engine includes a first injection valve, which is one of a port injection valve that injects fuel into an intake passage and a direct injection valve that injects fuel into a combustion chamber, and a second injection valve, which is the other, the air-fuel ratio control apparatus comprising circuitry that is configured to set a base injection amount, which is an open-loop operation amount for controlling an air-fuel ratio to a target value;

calculate a feedback operation amount for controlling a detection value of the air-fuel ratio to the target value;

perform, to supply fuel to the combustion chamber of the engine, at least one of an operation of the first injection valve based on the base injection amount that has been corrected using the feedback operation amount and a first learning value, and an operation of the second injection valve based on the base injection amount that has been corrected using the feedback operation amount and a second learning value;

update the first learning value based on the feedback operation amount when operating only the first injection valve;

when updating the first learning value, determine that the first learning value has converged to an appropriate value on condition that a correction ratio of the base injection amount, which is obtained using the feedback operation amount, is less than or equal to a predetermined ratio; and update the second learning value based on the feedback operation amount when operating both the first injection valve and the second injection valve, wherein the circuitry is configured to update the second learning value on condition that the first learning value is determined to have converged to the appropriate value and an injection distribution ratio, which is a ratio of an injection amount of the second injection valve to a total injection amount of the first injection valve and the second injection valve, is greater than or equal to a specified value, and refrain from updating the second learning value when the injection distribution ratio is less than the specified value.

* * * * *